US005245931A

United States Patent [19]

Cuny

[11] Patent Number: 5,245,931

[45] Date of Patent: Sep. 21, 1993

[54] DEVICE FOR ATTACHING A LOAD TO A CABLE

[75] Inventor: Bernard Cuny, Saint Nizier d'Uriage, France

[73] Assignee: Generale d'Articles de Materiels et d'Equipements de Sport et de Securite G.A.M.E.S., Saint Martin D'Heres, France

[21] Appl. No.: 530,178

[22] Filed: May 29, 1990

[30] Foreign Application Priority Data

May 31, 1989 [FR] France ..... 89 07200

[51] Int. Cl.[5] ..... B61B 12/12

[52] U.S. Cl. ..... 104/182

[58] Field of Search ..... 104/182, 229, 235, 236

[56] References Cited

U.S. PATENT DOCUMENTS

| | | | |
|---|---|---|---|
| 364,669 | 6/1887 | Prentice | 104/182 |
| 506,037 | 10/1893 | Forbes | 104/182 |
| 904,119 | 11/1908 | Downs | 104/182 |
| 1,733,640 | 10/1929 | Wright . | |
| 4,265,179 | 5/1981 | Tupper et al. | 104/182 |
| 4,357,889 | 11/1982 | Tupper | 114/111 |
| 4,462,316 | 7/1984 | Tupper | 104/182 |

FOREIGN PATENT DOCUMENTS

| | | |
|---|---|---|
| 544592 | 2/1956 | Belgium . |
| 0309183 | 3/1989 | European Pat. Off. . |
| 2096958 | 10/1981 | United Kingdom . |
| 2097052 | 10/1982 | United Kingdom . |
| 2133969 | 8/1984 | United Kingdom . |

*Primary Examiner*—Sherman Basinger
*Assistant Examiner*—Thomas J. Brahan
*Attorney, Agent, or Firm*—Beveridge, DeGrandi, Weilacher & Young

[57] ABSTRACT

Device (1) for attaching a load to a cable (22) or any other elongate element, comprising a first and a second coaxial wheel having star-shaped branches (5, 6) and a shoe (9) which is mounted on the branches of the wheels, in such a way that these can rotate relative to the shoe, the cable (22) being intended to pass between the wheels (2, 3) and under the shoe (9). The space (28) between two of the branches of the first wheel (2) is shaped in such a way that, when the cable (22) arranged between the wheels is engaged laterally into this shaped space (28), the shoe (9) can pass over the cable (22), at the same time crossing the shaped space (28), so that the cable (22) and the device (1) can be coupled or uncoupled.

19 Claims, 7 Drawing Sheets

DEVICE FOR ATTACHING A LOAD TO A CABLE

BACKGROUND OF THE INVENTION

The present invention relates to a device for attaching a load to a cable or any other elongate element.

There is a known device for attaching a load to a cable, which comprises two coaxial wheels having star-shaped branches, and a shoe which is mounted on the tops of the branches of the wheels, in such a way that these can rotate relative to the shoe. In the coupled position, the cable tensioned between two fastening points extends between the wheels and underneath the shoe, in such a way that the device is shiftable along the cable as a result of the sliding of the shoe on the latter. This known device is designed so as to be capable of crossing suspension rings carrying the cable between its fastening points. When the device meets a ring during its shifting movement along the cable, part of the ring engages between two respective branches of the wheels and causes these to rotate relative to the shoe which then passes through this ring.

This known device nevertheless has one disadvantage. In fact, at least one of the ends of the tensioned cable has to be secured by means of a special Y-shaped piece making it possible to couple or uncouple the device and the cable at the end of the latter, this coupling or uncoupling operation being carried out in the same way as that allowing a ring to be crossed.

The subject of the present invention is an improvement to the abovementioned attaching device, so that it can be coupled to or uncoupled from the cable at any location along the latter.

SUMMARY OF THE INVENTION

The device according to the invention for attaching a load to a cable or any other elongate element comprises a first and a second coaxial wheel having star-shaped branches, and a shoe which is mounted on the branches of the wheels, in such a way that these can rotate relative to the shoe, the cable being intended to pass between the wheels and under the shoe.

According to the present invention, the space between two of the branches of the first wheel is shaped in such a way that, when the cable is arranged between the wheels and is engaged laterally into this shaped space, the shoe can pass over the cable, at the same time crossing this shaped space, so that the cable and the device can be coupled or uncoupled.

According to the invention, a locking means is preferably provided in order to limit or prevent the lateral engagement of the cable into the abovementioned shaped space of the first wheel, so as thereby to prevent the abovementioned passage of the shoe over the cable.

According to the invention, the other spaces separating the branches of the said first wheel are preferably shaped so as to prevent the abovementioned passage of the shoe over the cable.

The, the space between two of the branches of its second wheel is shaped in such a way that, when the cable passes between the wheels and is engaged laterally into the shaped space of its first wheel and into the shaped space of its second wheel, the shoe can pass over the cable, at the same time crossing the abovementioned shaped space of the first wheel.

According to the invention, the abovementioned shaped space of its second wheel can advantageously be shaped in such a way that, when the cable is arranged between the wheels and is engaged laterally into the abovementioned shaped spaces, the shoe can pass over the cable, at the same time crossing the shaped space of its second wheel.

According to the invention, a second locking means is preferably provided in order to limit or prevent the lateral engagement of the cable into the abovementioned shaped space of its second wheel.

According to the invention, the other spaces separating the branches of the second wheel can advantageously be shaped so as to prevent the abovementioned passage of the shoe over the cable.

The the said locking means consists of a flange coaxial relative to the said wheels and located adjacent to the outer face of the associated wheel, this flange having on its periphery a notch, into which the cable engages laterally when this notch coincides with the abovementioned shaped space, so as thereby to allow the abovementioned passage of the shoe over the cable.

The said locking means can be formed by a means obstructing the notch of the said flange, so as thereby to prevent the abovementioned passage of the shoe over the cable.

If appropriate, a means can be provided for maintaining the said flange in such a position that its notch does not coincide with the abovementioned shaped space of the associated wheel.

BRIEF DESCRIPTION OF THE DRAWINGS

The present invention will be understood better from a study of a device for attaching a load to a cable or any other elongate element, described by way of non-limiting example and illustrated in the drawing in which.

DESCRIPTION OF THE PREFERRED EMBODIMENTS

Figure 1:
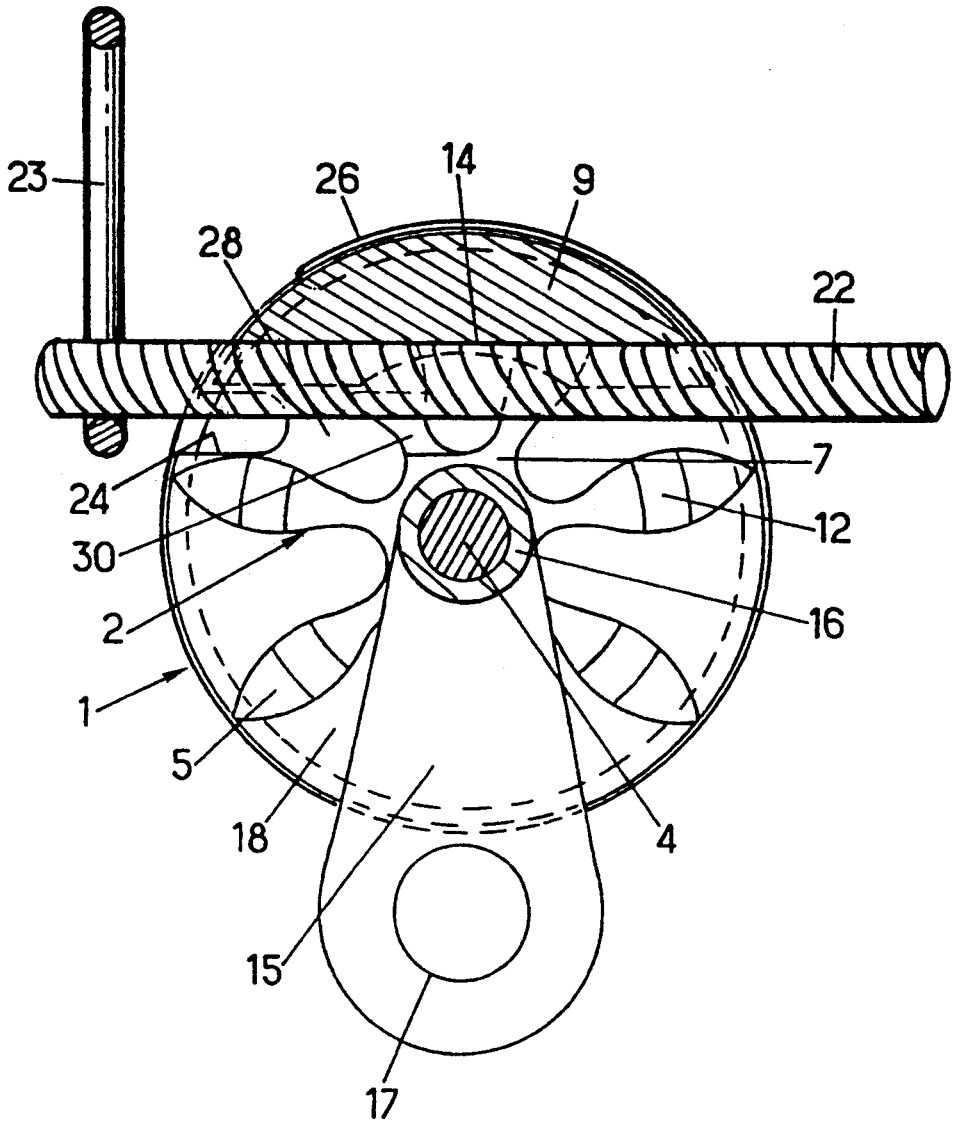
FIG. 1 shows an attaching device according to the present invention, in longitudinal section in the direction of the cable, in the operating position.

The attaching device illustrated in the Figures and designated as a whole by the reference 1 comprises two coaxial wheels 2 and 3 which are mounted rotatably at a distance from one another on an axle 4. In the example, these wheels 2 and 3 possess respectively seven branches 5 and 6 which extend radially so as to form a star about central hubs 7 and 8 and which are distributed uniformly.

The attaching device 1 also comprises a shoe 9 which is arranged between the wheels 2 and 3 and which extends over some of the periphery of these. This shoe 9 has, on each side, arcuate ribs 10 and 11 which are concentric relative to the wheels 2 and 3 and which are respectively engaged in arcuate grooves 12 and 13 made in the mutually confronting faces of the branches 5 and 6 of the wheels 2 and 3 and which are concentric relative to these. The length of the lateral ribs 10 and 11 of the shoe 9 is such that these ribs 10 and 11 remain in engagement with two adjacent branches of the wheels 2 and 3 when these rotate relative to the shoe 9.

Moreover, the shoe 9, on its inner plane face 14*a* confronting the axle 4, possesses a longitudinal groove 14 which has a curved shape, as seen in cross-section in the direction of the axle 4.

The attaching device 1 also comprises a lug 15 for attaching the load. This lug 15 extends between the wheels 2 and 3 and at one of its ends has a hub 16, through which the axle 4 passes and which forms a spacer for the wheels 2 and 3 and of which the other end extending on the outside of the space separating the wheels 2 and 3 has an orifice 17 for attaching the load.

The attaching device 1 comprises, furthermore, two flanges which consist of two discs 18 and 19 arranged respectively adjacent to the outer radical faces of the wheels 2 and 3 and are mounted rotatably on the ends of the axle 4, these discs 18 and 19 having a diameter substantially equal to the diameter of the wheels 2 and 3. The ends of the axle 4 are, for example, swaged so as to form two shoulders 20 and 21 which retain with the desired play the stack consisting of the disc 18, wheel 2, hub 7 of the wheel 2, hub 16 of the attaching arm 15, hub 8 of the wheel 3 and disc 19.

Figure 2:
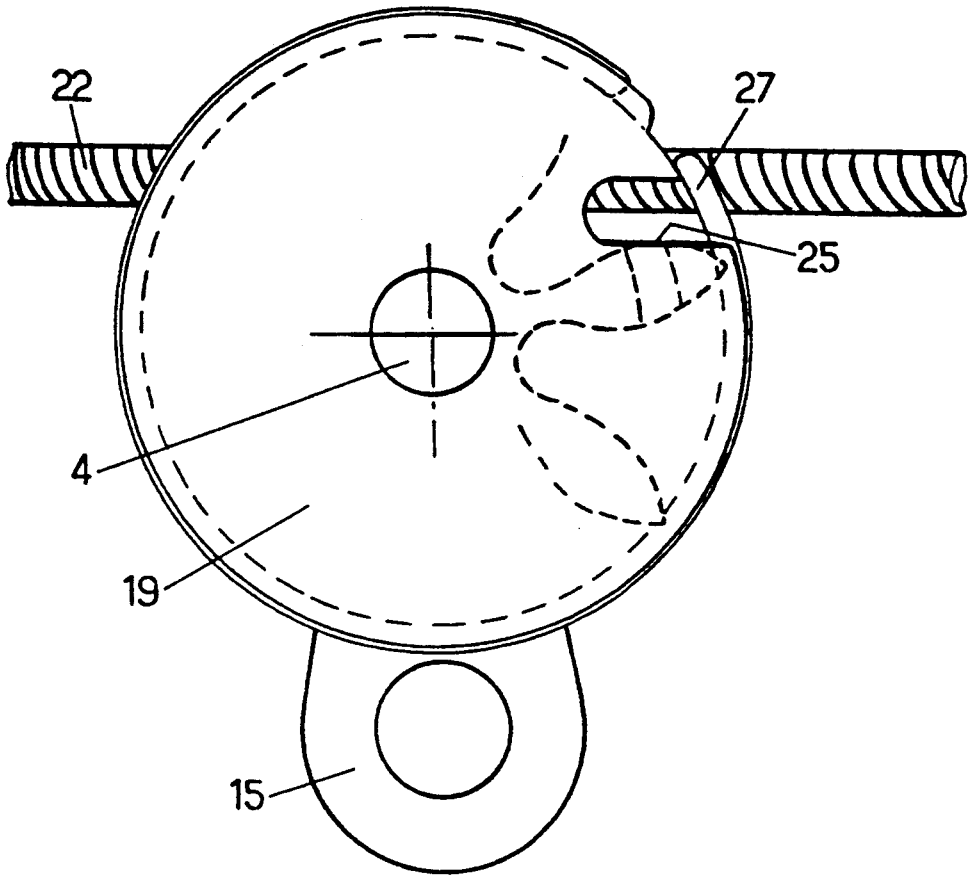
FIG. 2 shows a side elevation view of the attaching device.

In the operating position shown in FIGS. 1 and 2, the attaching device 1 is coupled to a cable 22 which extends between two fastening points (not shown) so as to be tensioned or virtually tensioned. In this coupled position, the cable 22 extends between the wheels 2 and 3 and between the shoe 9 and the hub 16 of the attaching arm 15, the cable extending underneath the shoe 9 and bearing in the longitudinal groove 14 of the latter, and the axle 4 extending transversely relative to the cable 22 and underneath it. A space remains between the cable 22 and the hub 16 of the load-attaching lug 15 which extends downwards.

As can be seen in FIG. 1, between its anchored ends the cable 22 is carried by suspension rings 23. When the attaching device 1 is shifted along the cable 22 and meets a ring 23, the lower part of the latter engages respectively between two adjacent branches of the wheels 2 and 3 and between the lateral discs 18 and 19. The ring 23 causes the wheels 2 and 3 to rotate, the shoe 9 passes through this ring 23, and the lower part of this ring passes between the cable 22 and the hub 16 of the attaching lug 15. The attaching device 1 has thus crossed the ring 23.

How the attaching device 1 is designed to be uncoupled from the cable 22 will now be described.

It can be seen from the Figures that discs 18 and 19 of the attaching device 1 possess respectively, starting from their periphery, notches 24 and 25 and on their periphery carry rings 26 and 27 which grip them elastically so that they are slidable only under the action of a force. These rings 26 and 27 are intended for obstructing the notches 24 and 25 by the peripheral entrance, but are slidable so as to open these notches 24 and 25, the ends of the rings 26 and 27 then being arranged on either side.

Starting from the operating position described above and illustrated in FIGS. 1 and 2, in which the elastic rings 26 and 27 obstruct the notches 24 and 25 of the discs 18 and 19, these rings are slid relative to these flanges so as to open the peripheral entrance of the notches 24 and 25, and the attaching device 1 is raised relative to the cable 22, in such a way that the inner face 14*a* of the shoe 9, in which the longitudinal groove is made, extends above the cable 22.

Discs 18 and 19 are rotated in order to bring their respective notches 24 and 25 laterally relative to the cable 22 on either side of the longitudinal ends of the shoe 8.

The wheel 2 is then rotated so as to bring the space 28 separating two particular branches 5*a* and 5*b* of this wheel laterally relative to the cable 22 into coincidence with the notch 24 of the discs 18, and the wheel 3 is rotated in order to bring the space 29 separating two particular branches 6*a* and 6*b* of this wheel laterally relative to the cable 22 into coincidence with the notch 25 of the disc 19, the branches 5*b* and 6*b* of the wheels 2 and 3 extending upwards at an inclination. In the disclosed embodiment, the spaces 28 and 29 differ from the other spaces between the branches of the wheels 2 and 3, in the respect that they include oblique cable-receiving recesses 30 and 31, the purpose of which will be described below.

Figure 3:
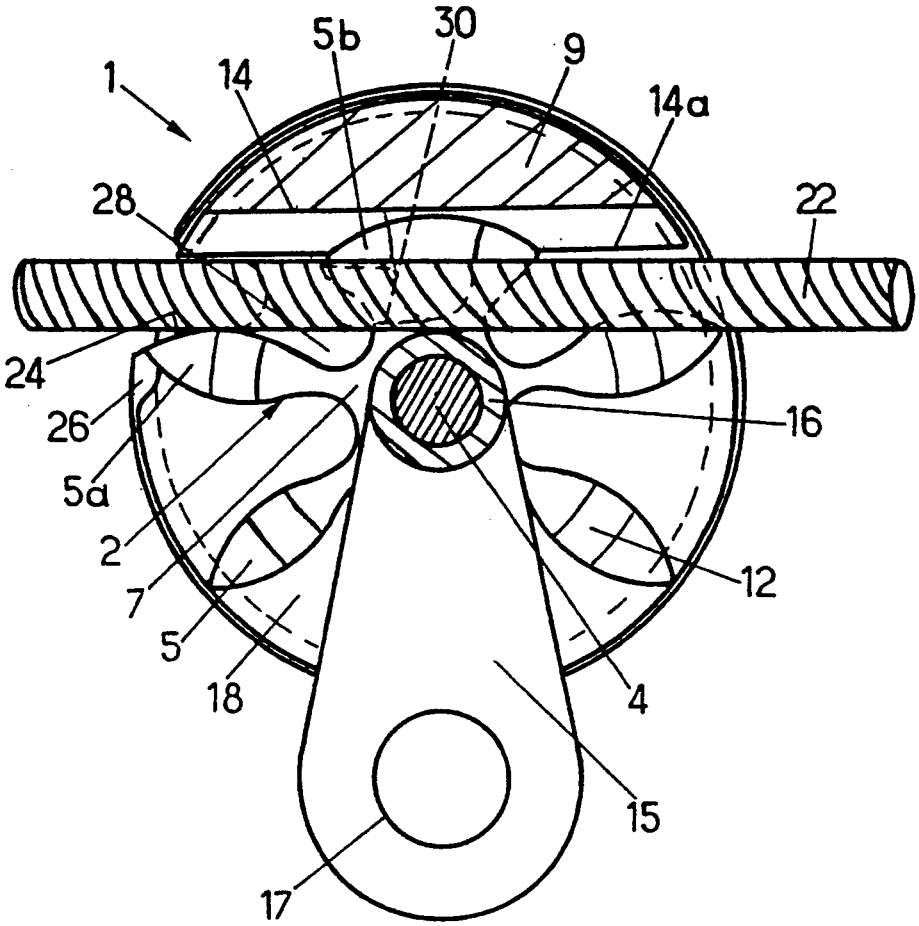
FIG. 3 shows a longitudinal section of the attaching device in the direction of the cable, in a position raised relative to the cable.

The attaching device 1 is thus in the position shown in FIG. 3.

Figure 4:
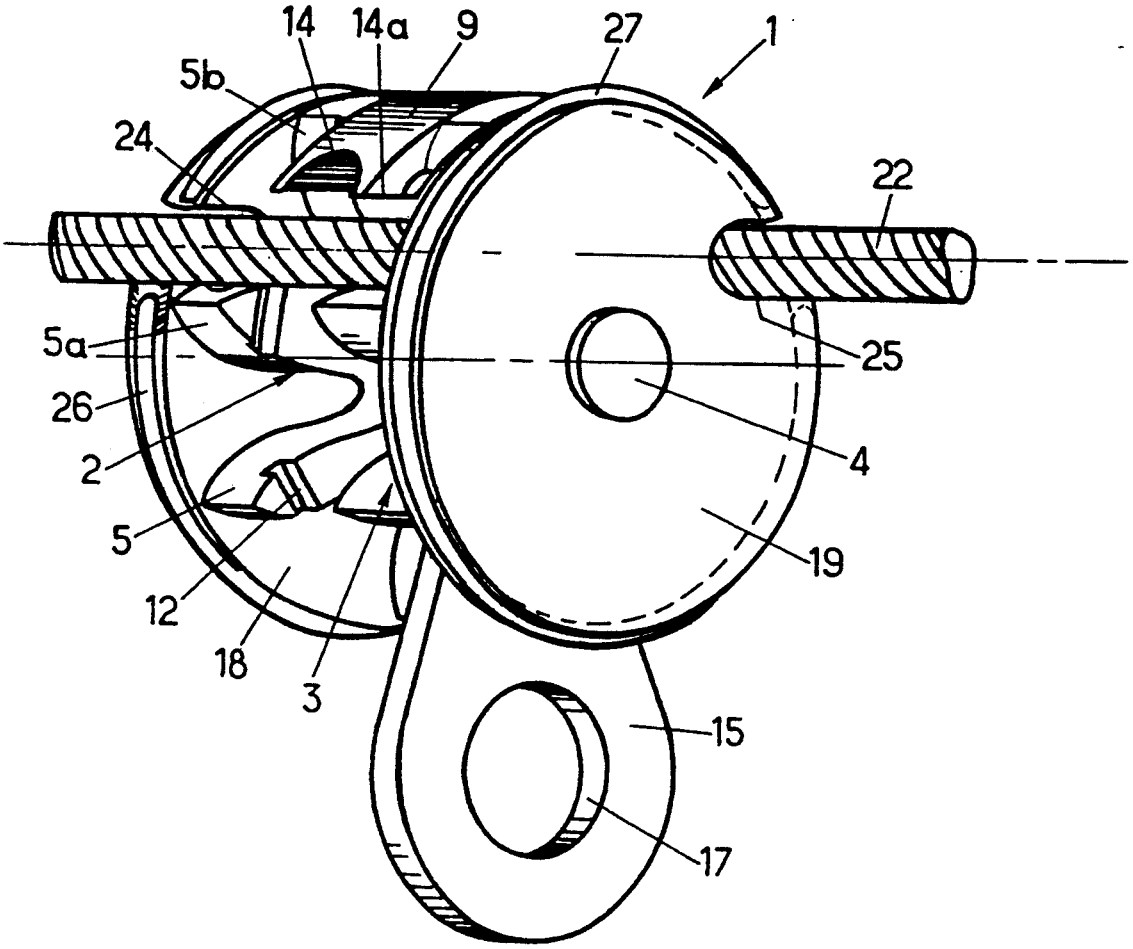
FIG. 4 shows a perspective view of the attaching device in a position pivoted relative to the cable.

Starting from this position, the attaching device 1 is pivoted horizontally relative to the cable 22, so as to engage this laterally into the abovementioned spaces 28 and 29 of the wheels 2 and 3 and into the notches 24 and 25 of the discs 18 and 19. The cable 22 is thus athwart to the attaching device 1 as shown in FIG. 4, in the example shown the cable 22 and the axle 4 being substantially at 45°. This pivoting movement of the attaching device is made possible because the abovementioned spaces 28 and 29 of the wheels 2 and 3 and the notches 24 and 25 of the discs 18 and 19 are shaped for this purpose. To achieve this, the foot of the branch 2*b* of the wheel 2 and the foot of the branch 3*b* of the wheel 3 have respective recesses 30 and 31, into which the cable 22 engages.

Figure 5:
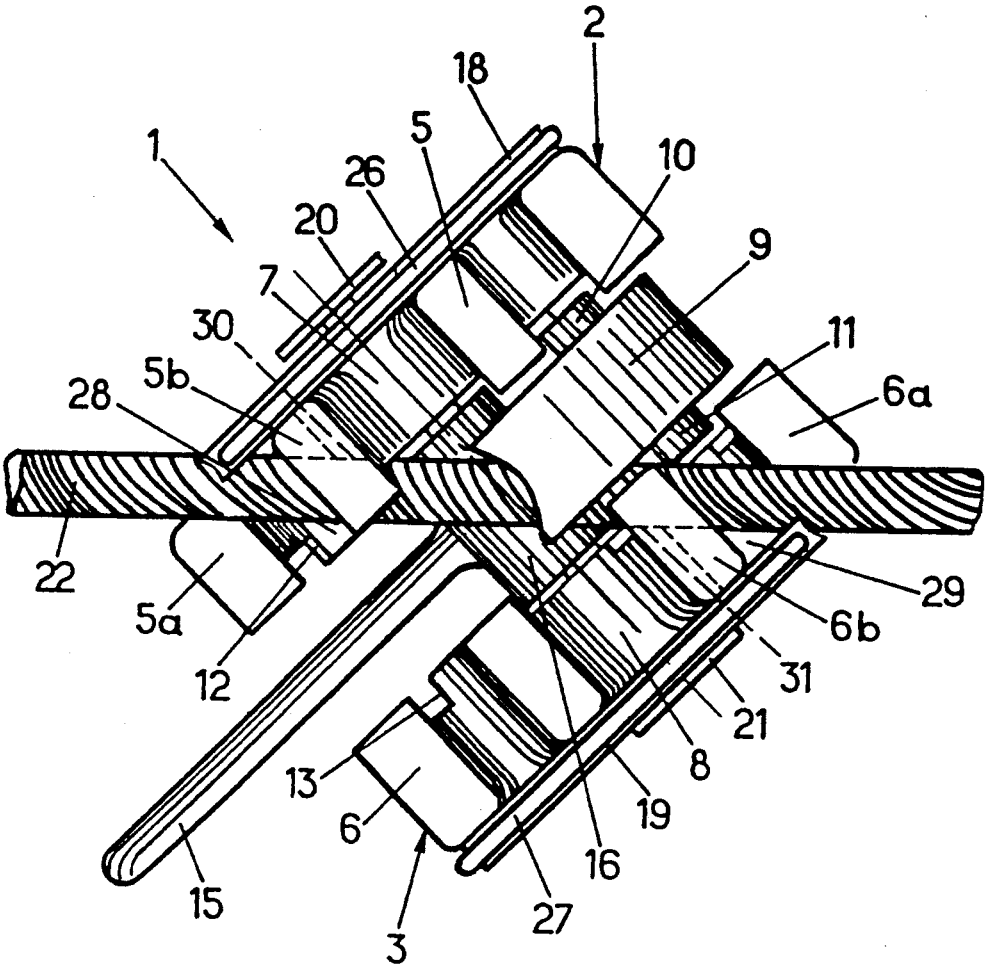
FIG. 5 shows a top view of the attaching device in an intermediate uncoupling position.

Starting from the pivoted position of the attaching device 1, shown in FIG. 4, the shoe 9 is pivoted relative to the wheels 2 and 3 on one side or the other, for example on the same side as the space 29 of the wheel 3. The shoe 9 thereby engages over the cable 22. The attaching device 1 is thus in the position shown in FIG. 5.

Figure 6:
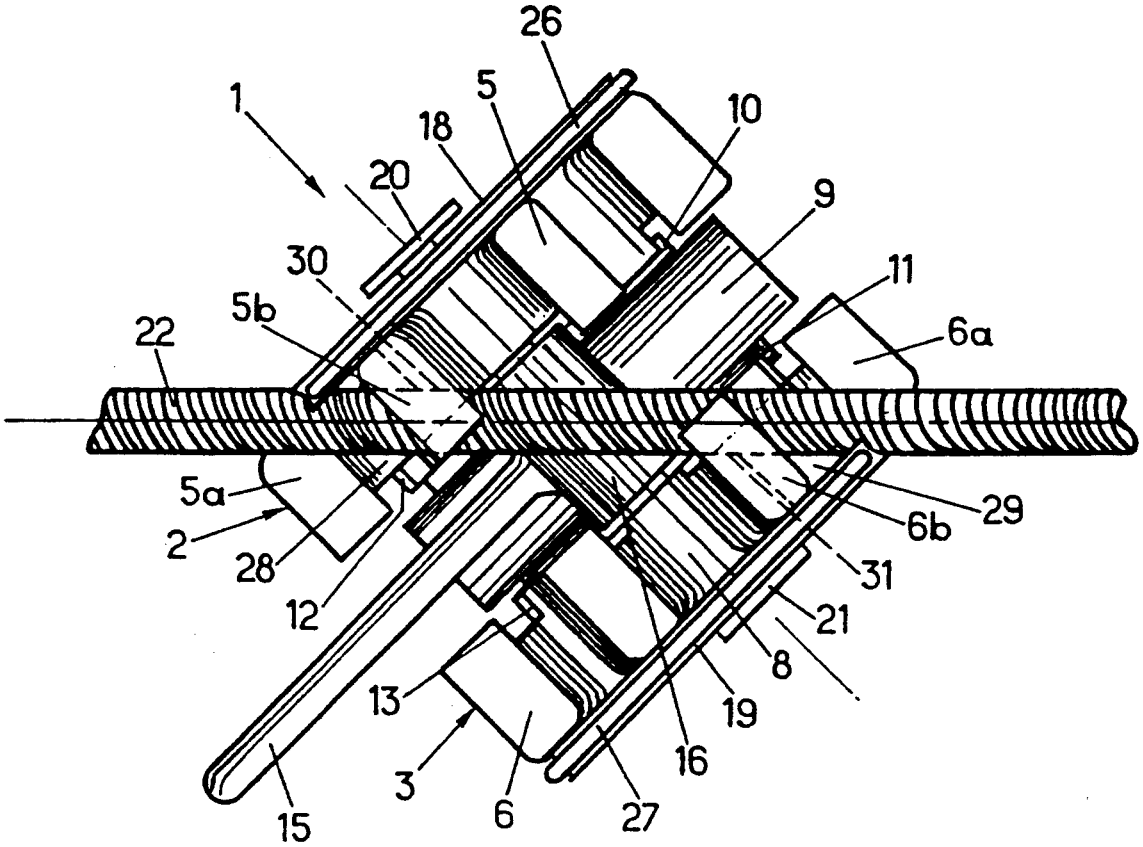
FIG. 6 shows a top view of the attaching device in another intermediate uncoupling position.

By continuing this pivoting movement of the shoe 9, it is brought beyond the cable 22, for example into its position swung down completely, as shown in FIG. 6.

Figure 7:
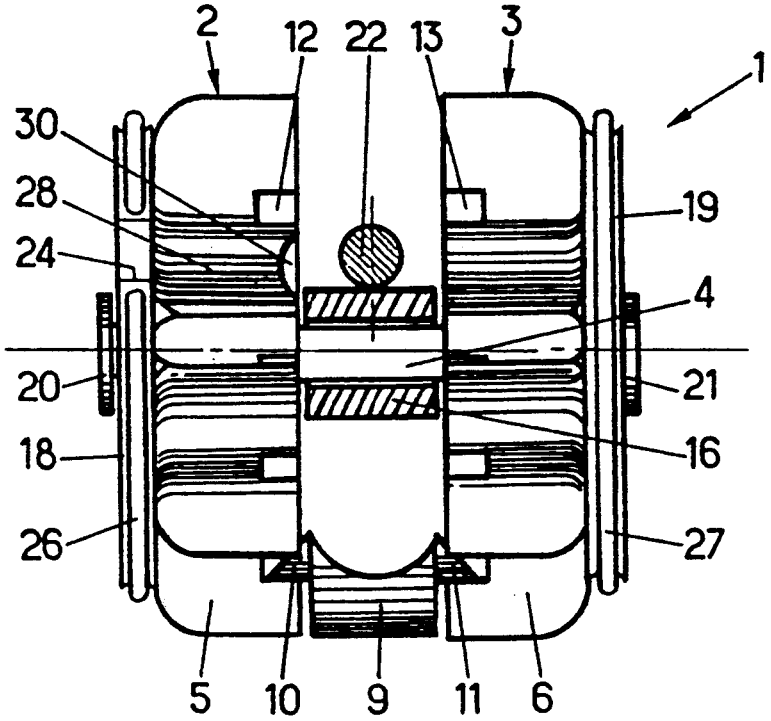
FIG. 7 shows an outer view of the device in the direction of the cable, in the final uncoupling position.

Finally, the attaching device 1 is pivoted in the other direction, so as to release the cable 22 from the notches 24 and 25 of the discs 18 and 19 and from the spaces 28 and 29 of the wheels 2 and 3, in order to return it into the space separating the wheels 2 and 3, as shown in FIG. 7, the axle 4 being perpendicular relative to the cable 22. It can be seen from this Figure that, in this position, the attaching device 1 is uncoupled from the cable 22.

To couple the attaching device 1 to the cable 22, the procedure described above is carried out in reverse order.

The attaching device 1 just described has the necessary degree of safety when it is coupled to the cable 22. In fact, for the attaching device to be uncoupled from the cable 22, the requisite action is to cause the rings 26 and 27 to slide relative to the discs 18 and 19 in order to open the notches 24 and 25, the device has to be raised relative to the cable 22 and these discs 18 and 19 and the spaces 28 and 29 of the wheels 2 and 3 have to be appropriately positioned laterally relative to the cable 22, and it is necessary to pivot the device horizontally. If only one of these conditions is not satisfied, the attaching device 1 cannot be uncoupled.

In the example, only the spaces 28 and 29 separating the branches 5a, 5b and 6a, 6b of the wheels 2 and 3 are shaped to receive the cable 22 laterally. On the contrary, the other spaces separating the other branches of the wheels 2 and 3 are shaped to prevent the pivoting of the shoe 9 over the cable 22.

The present invention is not limited to the example described above. In particular, the abovementioned safety conditions could be limited, whilst at the same time ensuring the coupling and uncoupling of the attaching device of the invention on a cable by passing the shoe over the latter when it is pivoted relative to at least one of the wheels.

I claim:

1. A horizontally movable device for supporting a load from a cable or other horizontally elongated element for movement therealong, comprising, a shoe having a lower surface which is on said elongated element to support the device from the elongated element, first and second rotatable coaxial wheels which rotate about a common axis, each of said wheels having a plurality of radiating branches separated by spaces, said branches being engaged with and supported by the shoe to permit the wheels to rotate relative to the shoe, said wheels being spaced apart laterally so as to lie on opposite sides of said elongated element, said device being movable from a normal orientation where said axis is perpendicular to the elongated element to a coupling/uncoupling orientation where said axis is oblique to the elongated element, a first said space of the first wheel being shaped to receive the elongated element when the device is at its coupling/uncoupling orientation, said shoe being movable relative to the wheels when the device is at its coupling/uncoupling orientation, past the first space where said elongated element is received, and between a position above the elongated element and a position below the elongated element to couple and uncouple the device from the elongated element.

2. A device according to claim 1 wherein, except for said first space, all of said spaces between the branches of said first wheel are shaped to prevent the elongated element from entering said spaces.

3. A device according to claim 1, wherein one of said spaces between the branches of the second wheel is a second said space which is shaped to receive the elongated element when the device is at its coupling/uncoupling orientation.

4. A device according to claim 3 wherein the shoe is movable relative to the wheels when the device is at its coupling/uncoupling orientation, past the second said space where said elongated element is received, and between a position above the elongated element and a position below the elongated element to couple and uncouple the device from the elongated element.

5. A device according to claim 3 wherein the shoe is movable relative to the wheels when the device is at its coupling/uncoupling orientation, past the second space where said elongated element is received, and between a position above the elongated element and a position below the elongated element to couple and uncouple the device from the elongated element.

6. A device according to claim 5 having means which prevent the device from moving to a coupling/uncoupling orientation when one of the other spaces of said second wheel is beside the elongated element.

7. A device according to claim 5 wherein, except for said first space, all of said spaces between the branches of said first wheel are shaped to prevent the elongated element from entering them and occupying a coupling/uncoupling position therein.

8. A device according to claim 5 having an obstructing means which is movable between (a) a first position where it obstructs movement of the elongated element into a coupling/uncoupling position in said first shaped space and (b) a second position where it allows movement of the elongated element into said coupling/uncoupling position in said second space.

9. A device according to claim 8 wherein the obstructing means is a flange which is coaxial with respect to said wheels and located adjacent to and outside of a said wheel, said flange having a peripheral notch for receiving said elongated member when the obstructing means is in its second position and the device is at its coupling/uncoupling orientation.

10. A device according to claim 8 including an element for obstructing said notch to prevent movement of the elongated element into said first space and to prevent the device from moving to said coupling/uncoupling orientation, said element being movable to a nonobstructing position to permit movement of the elongated element into said notch for coupling and uncoupling procedures.

11. A device according to claim 1 having an obstruction which is movable between (a) a first position where it obstructs movement of the elongated element into said first space and (b) a second position where it allows movement of the elongated element into said first space.

12. A device according to claim 11 wherein the obstruction is a flange which is coaxial with respect to said wheels and located adjacent to and outside said first wheel, said flange having a peripheral notch for receiving said elongated member when the obstruction is in its second position and the device is at its coupling/uncoupling orientation.

13. A device according to claim 1 including an element for obstructing said notch to prevent movement of the elongated element into said notch, said element being movable to a nonobstructing position to permit movement of the elongated element into said notch for coupling and uncoupling procedures.

14. A device according to claim 1 having an axle which connects said wheels together, and a load-receiving attachment supported on and extending down from said axle.

15. A device according to claim 1 having means which prevent it from moving to said coupling/uncoupling orientation when one of the other spaces of said first wheel is beside the elongated element.

16. A device according to claim 1, wherein said shoe extends between said wheels, said shoe being slidably connected to said wheels by corresponding arcuate ribs and grooves.

17. A device according to claim 1 wherein, except for said first space, all of said spaces between the branches of said first wheel are shaped to prevent the elongated element from entering them and occupying a coupling/uncoupling position therein.

18. A device according to claim 1 having an obstructing means which is movable between (a) a first position where it obstructs movement of the elongated element into a coupling/uncoupling position in said first space and (b) a second position where it allows movement of the elongated element into said coupling/uncoupling position in said first space.

19. A device according to claim 18 wherein the obstructing means is a flange which is coaxial with respect to said wheels and located adjacent to and outside of a said wheel, said flange having a peripheral notch for receiving said elongated member when the obstructing means is in its second position and the device is at its coupling/uncoupling orientation.

* * * * *